US010848844B2

(12) United States Patent
Brousseau

(10) Patent No.: US 10,848,844 B2
(45) Date of Patent: Nov. 24, 2020

(54) DEVICE FOR INSTALLATION AND REMOVAL OF A CEILING SPEAKER SYSTEM

(71) Applicant: Bose Corporation, Framingham, MA (US)

(72) Inventor: Kevin Joseph Brousseau, Brighton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/215,151

(22) Filed: Dec. 10, 2018

(65) Prior Publication Data

US 2020/0186902 A1 Jun. 11, 2020

(51) Int. Cl.
*H04R 1/02* (2006.01)

(52) U.S. Cl.
CPC ..... *H04R 1/026* (2013.01)

(58) Field of Classification Search
CPC . H04R 2201/021; F21V 21/04; F21V 21/041; F21V 21/042; F21V 21/043; F21V 21/044; F21V 21/045; F21V 21/046; F21V 21/048; F21V 21/049; F21S 8/026
See application file for complete search history.

(56) References Cited

U.S. PATENT DOCUMENTS 4,123,621 A * 10/1978 Walker ..... H04R 1/025 181/150
4,860,369 A * 8/1989 Koshimura ..... H04R 1/24 381/395
5,045,984 A * 9/1991 Trowbridge ..... F21V 17/164 362/365
5,077,650 A * 12/1991 Cestari ..... F21V 21/04 362/147
5,931,432 A * 8/1999 Herold ..... F21V 21/04 248/343
5,964,523 A * 10/1999 Eversberg ..... F21V 21/04 362/148

(Continued)

FOREIGN PATENT DOCUMENTS

EP 3288280 A1 2/2018
WO 2018/080821 A1 5/2018

OTHER PUBLICATIONS

International Search Report and Written Opinion dated Feb. 26, 2020 for PCT/US2019/065464.

*Primary Examiner* — Fan S Tsang
*Assistant Examiner* — Ryan Robinson
(74) *Attorney, Agent, or Firm* — Bose Corporation

(57) ABSTRACT

A method of installing a ceiling speaker system includes inserting a top end portion of an enclosure of a speaker system into a hole in a ceiling such that a spring-loaded tab of the speaker system is caused to pivot about a pivot axis as the spring-loaded tab comes into contact with an edge of the hole. The top end portion of the enclosure is moved upward, through the hole until the spring-loaded tab is clear of the hole. A lead screw of the speaker system is rotated about its longitudinal axis to cause the spring-loaded tab to be displaced toward a flange arranged along a bottom end portion of the speaker system, and thereby clamping the ceiling between the flange and the spring-loaded tab. The longitudinal axis of the lead screw is coincident with the pivot axis of the spring-loaded tab.

16 Claims, 18 Drawing Sheets

(56) References Cited

U.S. PATENT DOCUMENTS

| | | | | |
|---|---|---|---|---|
| 6,241,368 | B1 * | 6/2001 | Depino | F21V 21/04 362/147 |
| 7,676,045 | B2 * | 3/2010 | Merrey | H04R 1/025 381/386 |
| 7,731,130 | B2 * | 6/2010 | Decanio | H04R 1/2873 248/27.3 |
| 7,780,135 | B2 * | 8/2010 | Nelson | H04R 1/025 248/342 |
| 8,256,728 | B2 * | 9/2012 | Wright | H04R 1/025 181/150 |
| 9,438,974 | B2 * | 9/2016 | Marcum | H04R 1/02 |
| 9,774,937 | B2 * | 9/2017 | Shiojima | H04R 1/026 |
| 9,913,013 | B1 * | 3/2018 | Santoro | H04R 1/025 |
| 10,171,897 | B2 * | 1/2019 | Hart | H04R 1/025 |
| 10,247,394 | B2 * | 4/2019 | Bardot | F21S 8/02 |
| 10,281,120 | B1 * | 5/2019 | Winslett | F16M 13/022 |
| 2010/0158298 | A1 | 6/2010 | Tai | |
| 2011/0017889 | A1 * | 1/2011 | Nelson | B60R 11/0217 248/229.23 |
| 2012/0281410 | A1 * | 11/2012 | Wong | F21V 21/043 362/249.02 |
| 2017/0307134 | A1 * | 10/2017 | Padrin | F16M 13/02 |

* cited by examiner

DEVICE FOR INSTALLATION AND REMOVAL OF A CEILING SPEAKER SYSTEM

BACKGROUND

This disclosure relates to devices for mounting a speaker system to a ceiling. The devices provide temporary support during the installation process and clamp the speaker system to the ceiling to complete the installation process.

SUMMARY

All examples and features mentioned below can be combined in any technically possible way.

One aspect provides a device for securing an object to a ceiling. The device includes a lead screw having a longitudinal axis about which the lead screw rotates, and a spring-loaded tab. The spring-loaded tab includes a carriage that is coupled to the lead screw such that the carriage is displaceable along a length of the lead screw via rotation of the lead screw. The spring-loaded tab also includes a leg having a first end that is coupled to the carriage such that there is no relative movement between the leg and the carriage, and a second, free end. A spring biases the free end of the leg outwardly, away from the object into a deployed position. The leg is rotatable about a pivot axis coincident with the longitudinal axis of the lead screw. When the device is attached to the object and the object moves in a first direction through a hole in the ceiling such that the leg contacts an edge of the hole, the leg is urged from the deployed position toward a retracted position, and when the object is further moved in the first direction such the leg is clear of the hole, the leg returns to the deployed position via a force applied by the spring. The leg includes an angled surface that is configured to engage edge of the hole to urge the leg toward a retracted position as the object moves in the first direction through the hole.

Implementations may include one of the following features, or any combination thereof.

In some implementations, the device includes a retraction plate secured to the object so as to form a pocket therebetween, wherein, when the lead screw is rotated to drive the spring-loaded tab toward a top end portion of the object, the retraction plate engages the angled surface to urge the leg into the retracted position within the pocket.

In certain implementations, the angled surface is arranged at a first non-zero and non-normal angle, relative to the pivot and longitudinal axes, between the first and second ends of the leg.

In some examples, the angled surface also extends at a second non-zero and non-normal angle, relative to the pivot axis, between opposing sides of the leg.

In certain examples, the opposing sides of the leg lay in respective planes that are parallel with each other and with the pivot axis.

In some cases, the carriage and the leg are coupled such that relative movement therebetween is inhibited.

In certain cases, the carriage and the leg are integrally formed.

In some implementations, the carriage includes threaded surface that engages threads on the lead screw.

In certain implementations, the carriage includes a threaded insert which defines the threaded surface.

In some examples, the spring includes a first end that is coupled to the spring-loaded tab, and a second end that engages the object such that the second end slides along a surface of the object as the spring-loaded tab is displaced via rotation of the lead screw.

In certain examples, the first end of the spring includes a hook that is looped through an aperture in the spring-loaded tab.

In some cases, the object includes a rail, and the second end of the spring is looped through the rail, thereby to inhibit the second end of the spring from rotating away from the sidewall.

In certain cases, the device includes a retraction plate secured to the object so as to form a pocket therebetween, wherein, when the lead screw is rotated to drive the spring-loaded tab toward a top end portion of the object, the retraction plate engages the leg to urge the leg into the retracted position within the pocket.

Another aspect features a ceiling speaker system for mounting in a hole in a ceiling. The system includes an enclosure, an electro-acoustic transducer supported by the enclosure, and a plurality of lead screws supported by the enclosure. Each of the plurality of lead screws having a longitudinal axis about which the lead screw rotates. The system also includes a plurality of spring-loaded tabs. Each of the plurality of spring-loaded tabs includes a carriage that is coupled to the lead screw such that the carriage is displaceable along a length of an associated one of the plurality of lead screws via rotation of the associated one of the plurality of lead screws, and a leg including a first end that is coupled to the carriage such that there is no relative movement between the leg and the carriage, and a second, free end. A spring biasing the free end of the leg outwardly, away from the enclosure into a deployed position, the leg being rotatable about a pivot axis coincident with the longitudinal axis of the associated one of the plurality of lead screws. When a top end portion of the enclosure is moved in a first direction through a hole in a ceiling such that the legs contact an edge of the hole, the legs are urged from the deployed position toward a retracted position, and when the top end portion of the enclosure is further moved in the first direction such the legs are clear of the hole, the legs return to the deployed position via a force applied by the spring.

Implementations may include one of the above and/or below features, or any combination thereof.

In some implementations, the ceiling speaker system includes a plurality of retraction plates coupled to the enclosure so as to form respective pockets therebetween.

In certain implementations, the system includes a flange coupled to the enclosure, and wherein, when the top end portion of the enclosure is moved through the hole in the ceiling such that the legs are clear of the hole, the lead screws are rotatable to displace the spring-loaded tabs such that the ceiling is clamped between the spring loaded tabs and the flange.

In some examples, wherein each of the legs comprises an angled surface configured to engage edge of the hole to urge the leg toward a retracted position as the object moves in the first direction through the hole.

In certain examples, the system includes a plurality of retraction plates coupled to the enclosure so as to form respective pockets therebetween, and, when the lead screws are rotated to drive the spring-loaded tabs toward a top end portion of the enclosure, the retraction plates engage the angled surfaces to urge the legs into the retracted position within the pockets.

In some cases, the angled surface is arranged at a first non-zero and non-normal angle, relative to the pivot and longitudinal axes, between the first and second ends of the leg.

In certain cases, the angled surface also extends at a second non-zero and non-normal angle, relative to the pivot axis, between opposing sides of the leg.

In some implementations, the opposing sides of the leg lay in respective planes that are parallel with each other and with the pivot axis.

In certain implementations, the carriage and the leg of each of the spring-loaded tabs are coupled such that relative movement therebetween is inhibited.

Another aspect provides a method of installing a ceiling speaker system. The method includes inserting a top end portion of an enclosure of a speaker system into a hole in a ceiling such that a spring-loaded tab of the speaker system is caused to pivot about a pivot axis as the spring-loaded tab comes into contact with an edge of the hole. The top end portion of the enclosure is moved upward, through the hole until the spring-loaded tab is clear of the hole. A lead screw of the speaker system is rotated about its longitudinal axis to cause the spring-loaded tab to be displaced toward a flange arranged along a bottom end portion of the speaker system, thereby clamping the ceiling between the flange and the spring-loaded tab. The longitudinal axis of the lead screw is coincident with the pivot axis of the spring-loaded tab.

BRIEF DESCRIPTION OF THE DRAWINGS

Like reference numbers refer to like elements throughout the various figures.

DETAILED DESCRIPTION

Speaker systems and other objects or structures are often surface mounted to various structures such as ceilings. Different types of anchor systems can be used to reliably secure a speaker system to a mounting substrate. In the various examples of devices for securing an object to a ceiling described below, spring-loaded tabs are used to provide temporary support during an installation process. The described examples have the advantage of providing for easy removal of an object installed in a ceiling. In particular, the devices permit the spring-loaded tabs to retract during installation to and removal from a ceiling such that the object can pass through an opening in the ceiling without interference.

A ceiling, as used herein, means the upper interior structure of a room or dwelling. A ceiling may be horizontal or may be inclined at an angle from a horizontal orientation.

Figure 1A:
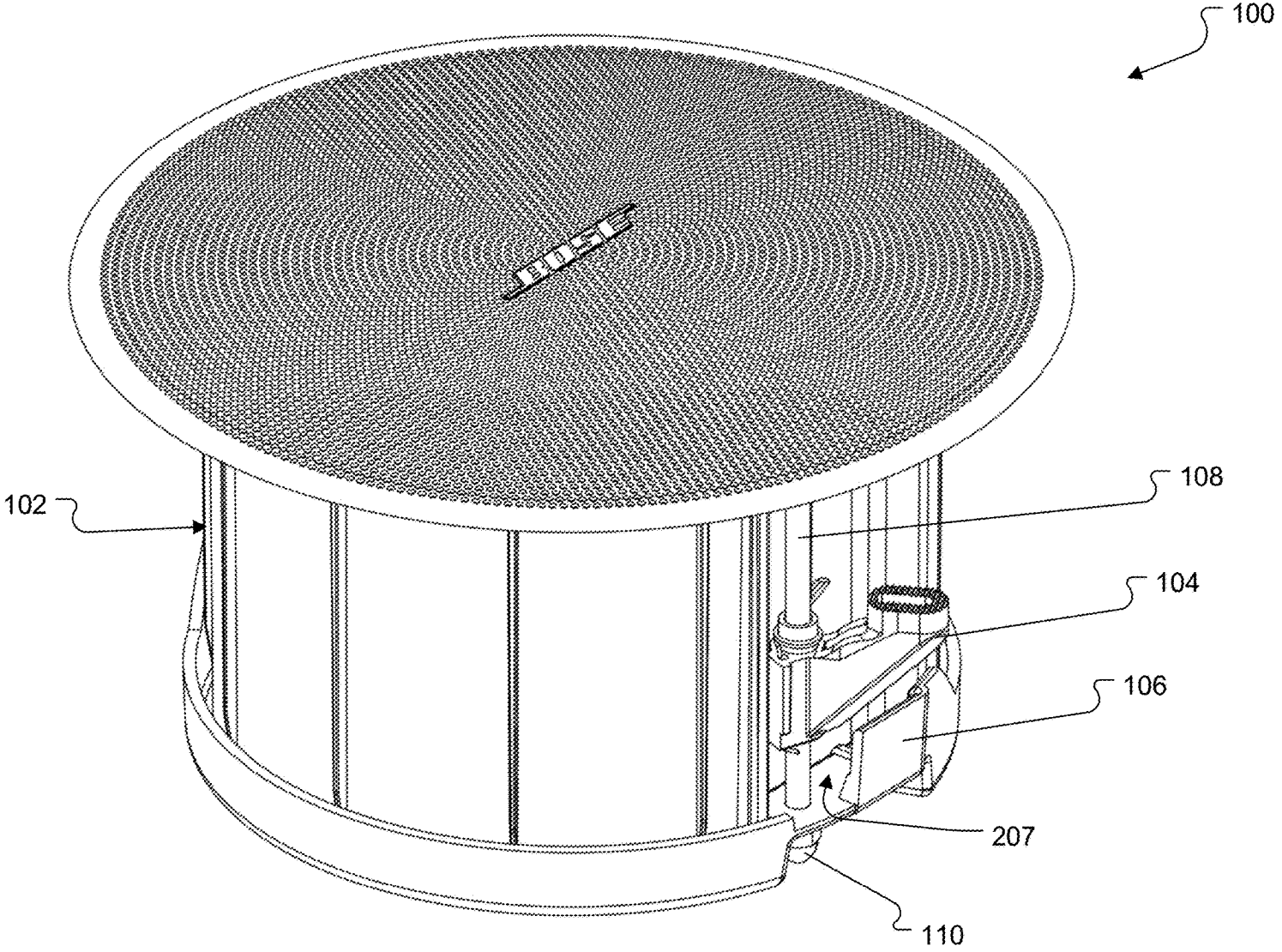
FIG. 1A is a perspective view of a ceiling speaker system as shown from the bottom and side.
Figure 1B:
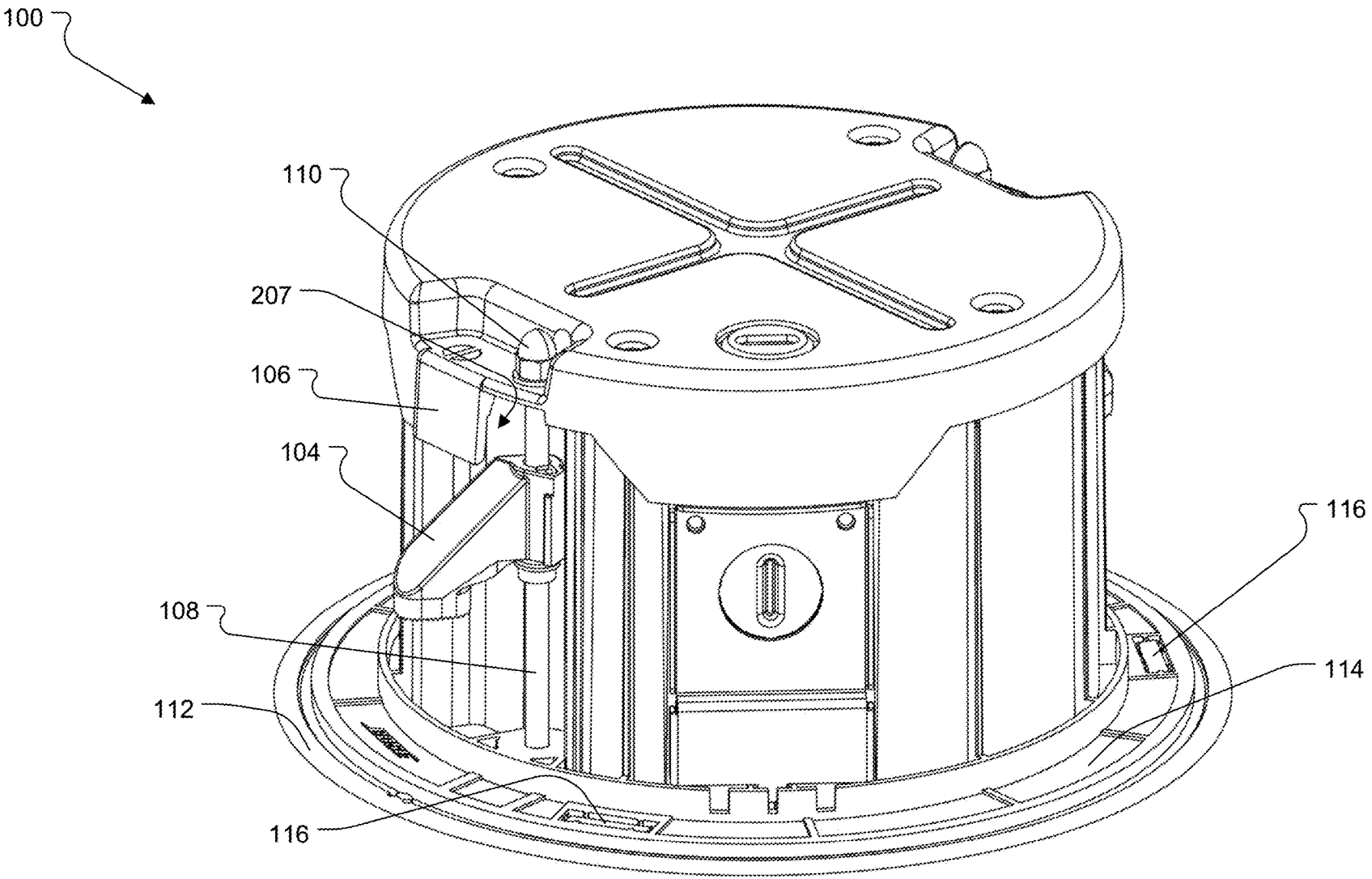
FIG. 1B is a perspective view of the ceiling speaker systems of FIG. 1A as shown from the top and side.

Referring to FIGS. 1A & 1B, a ceiling speaker system 100 includes an enclosure 102 and a plurality of mounting devices used to mount the system 100 to a ceiling. Each of the mounting devices includes a spring-loaded tab 104, a retraction plate 106, a lead screw 108, and a cap nut, or acorn nut, 110. An acoustically transparent grille 112 is releasably attached at the system base. For example, the grille 112 may be attached to a flange 114 via magnetic connectors 116 (FIG. 1B, see also FIG. 2A) on the flange 114 and/or the top side of the grille 112. The grille 112 shields and protects internal system components while being substantially acoustically transparent to acoustic signals generated by the speaker system 100.

Figure 2A:
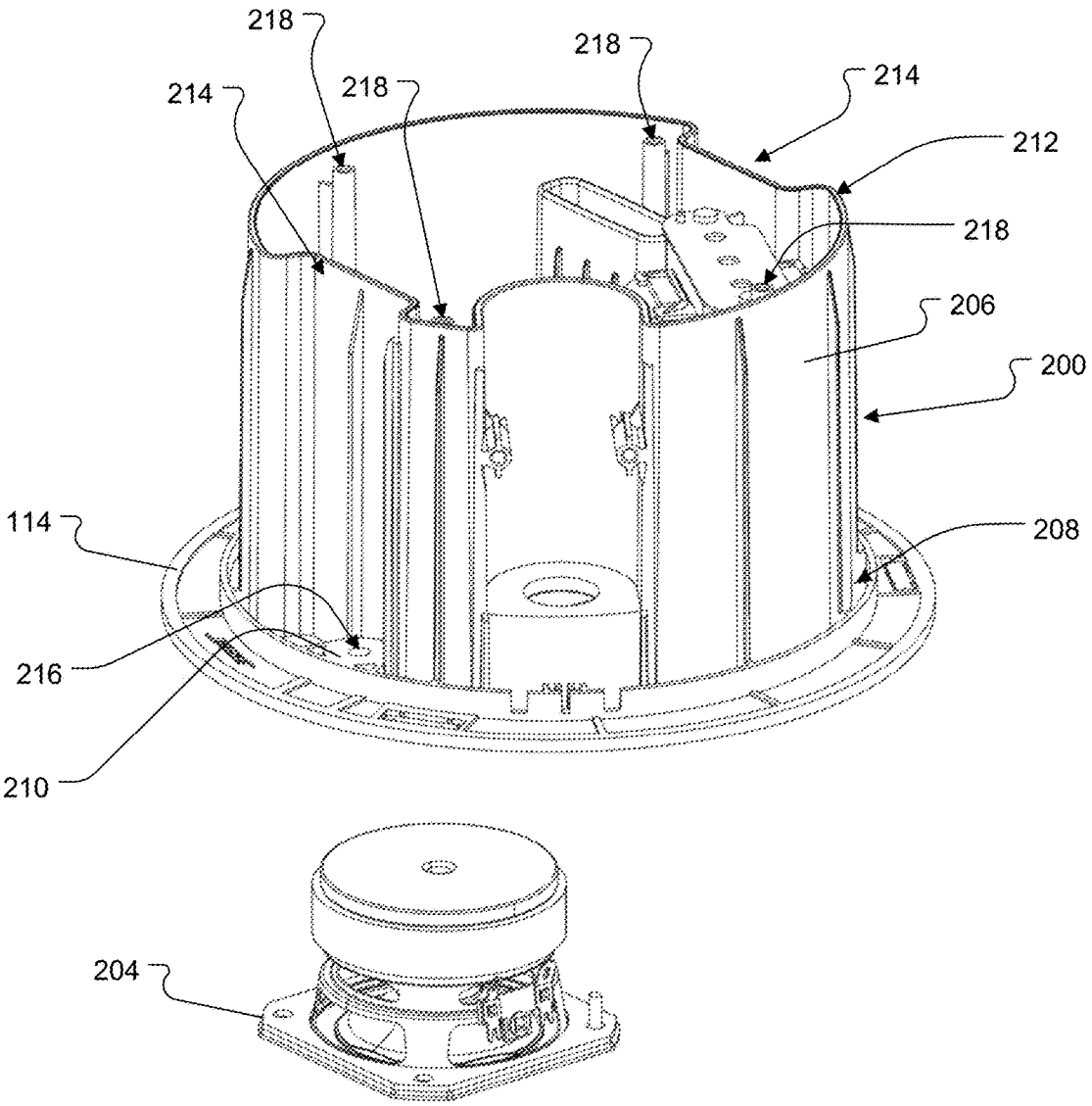
FIG. 2A is an exploded perspective view of a main body of the ceiling speaker system of FIG. 1A as shown from the top and side.
Figure 2B:
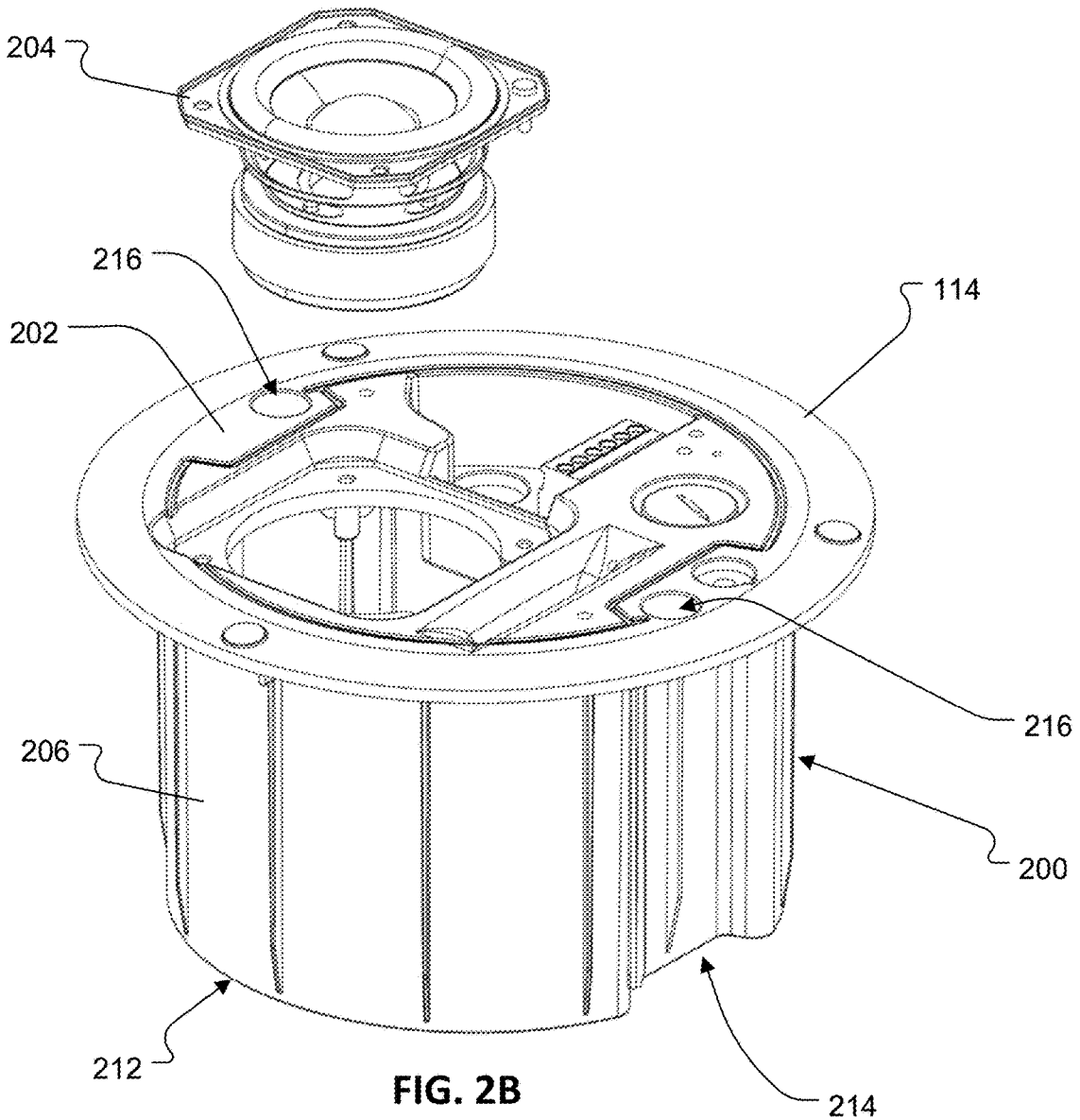
FIG. 2B is an exploded perspective view of the main body of FIG. 2A as shown from the bottom and side.

Referring to FIGS. 2A & 2B, a main body 200 of the enclosure 102 defines a baffle 202 (FIG. 2B), for receiving a supporting an electro-acoustic transducer 204. The flange 114 extends radially outward from the peripheral edge of the baffle 202. The main body 200 also defines a sidewall 206 that extends outwardly from a first, bottom end 208 coupled to a rear surface 210 of the baffle 202 to an open, second (top) end 212. The sidewall 206 includes recessed portions 214 for accommodating the lead screws 108 and spring-loaded tabs 104. A plurality of screw openings 216 are provided in the baffle 202 for accommodating respective ones of the lead screws 108, such that a head of each lead screw 108 is exposed along the baffle 202 and is engageable with a driver tool (e.g., a Phillips head screwdriver or a socket driver). In some cases, bushings or bearings may be disposed within or about the screw openings 216 to help enable rotation of the lead screws 108. A set of mounting holes 218 (four shown in FIG. 2A) are defined along the open end 212 of the main body 200 for coupling a top cover 300 (FIG. 3) thereto. The main body 200 may be formed as a unitary plastic part. In that regard, the baffle 202, sidewall 206, and flange 114 may be integrally formed in a machining and/or molding process.

Figure 3A:
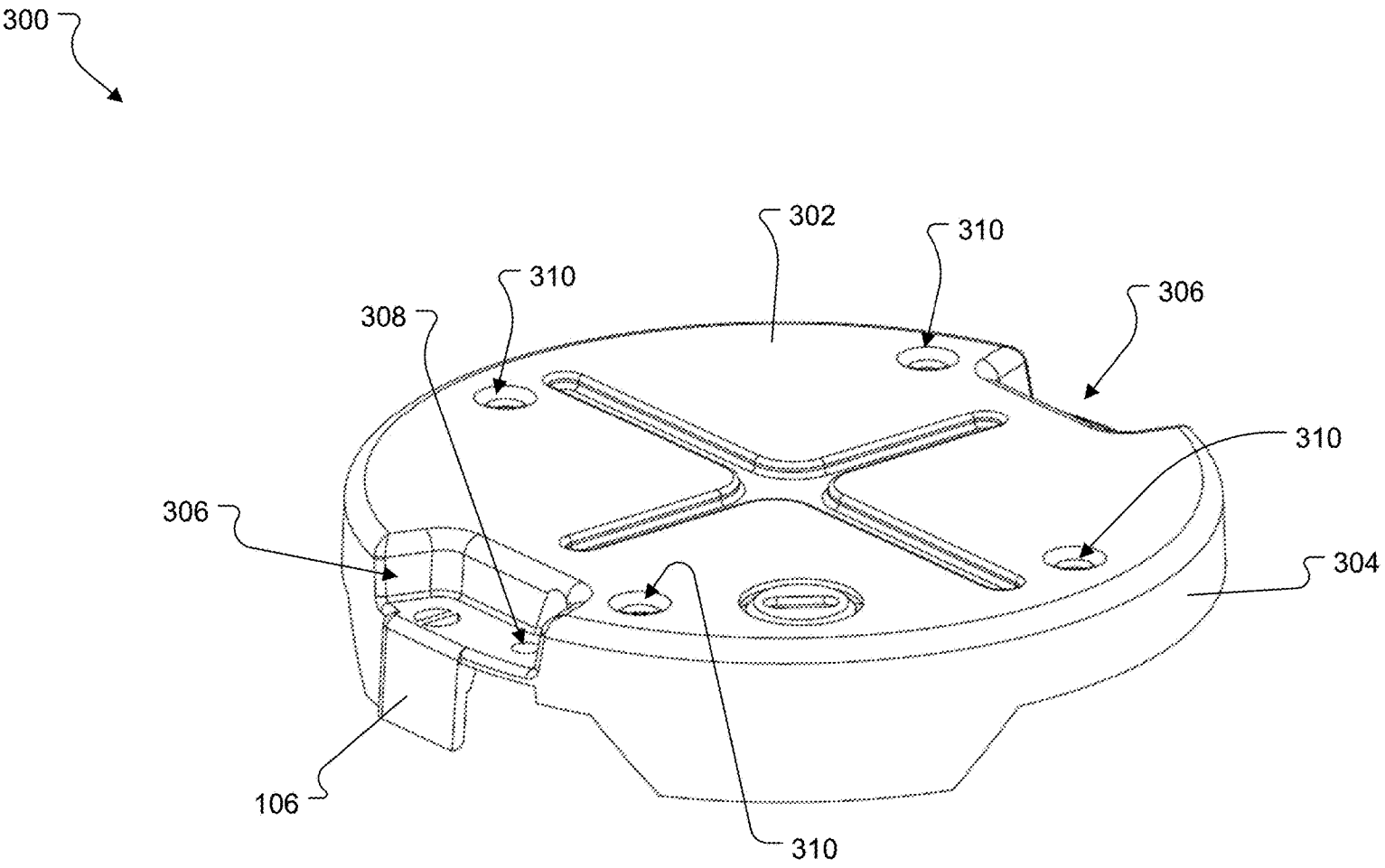
FIG. 3A is a perspective view of a top cover of the ceiling speaker system of FIG. 1A as shown from the top and side.
Figure 3B:
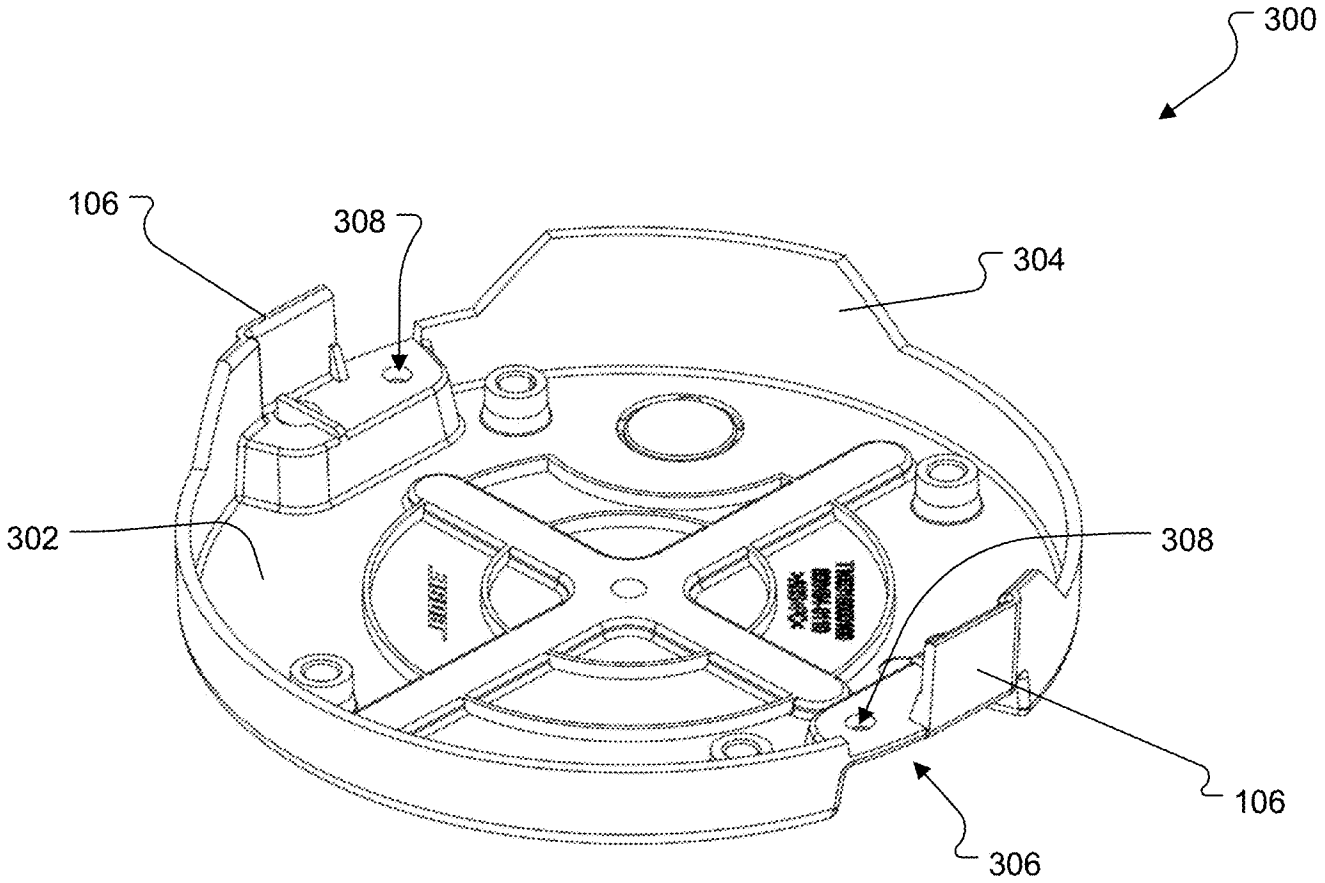
FIG. 3B is a perspective view of the top cover of FIG. 3A as shown from the bottom and side.

With reference to FIGS. 3A & 3B, the top cover 300 includes a substantially flat base 302 and a substantially cylindrical edge 304 that extends outward from the base 302. The top cover 300 also defines a pair of recesses 306 within which respective distal ends of the lead screws 108 are rotatably received and the acorn nuts 110 are disposed. The distal ends of the lead screws 108 are supported in screw openings 308 in the top cover 300. Along each of the recesses 306 the top cover 300 also forms a corresponding one of the retraction plates 106. In some cases, bushings or bearings may be disposed within or about the screw openings to help enable rotation of the lead screws 108.

The top cover 300 defines a plurality of screw holes 310 which align with mounting holes 218 in the main body 200 for receiving fasteners to secure the top cover 300 to the main body 200 to define an acoustic cavity therebetween. When assembled, the recesses 306 in the top cover 300 coincide with the recessed portions 214 in the sidewall 206. The retraction plates 106 and the recessed portions 214 in the sidewall 206 together define pockets 207 (FIG. 1A) for receiving the tabs 104 as discussed in greater detail below.

Figure 4:
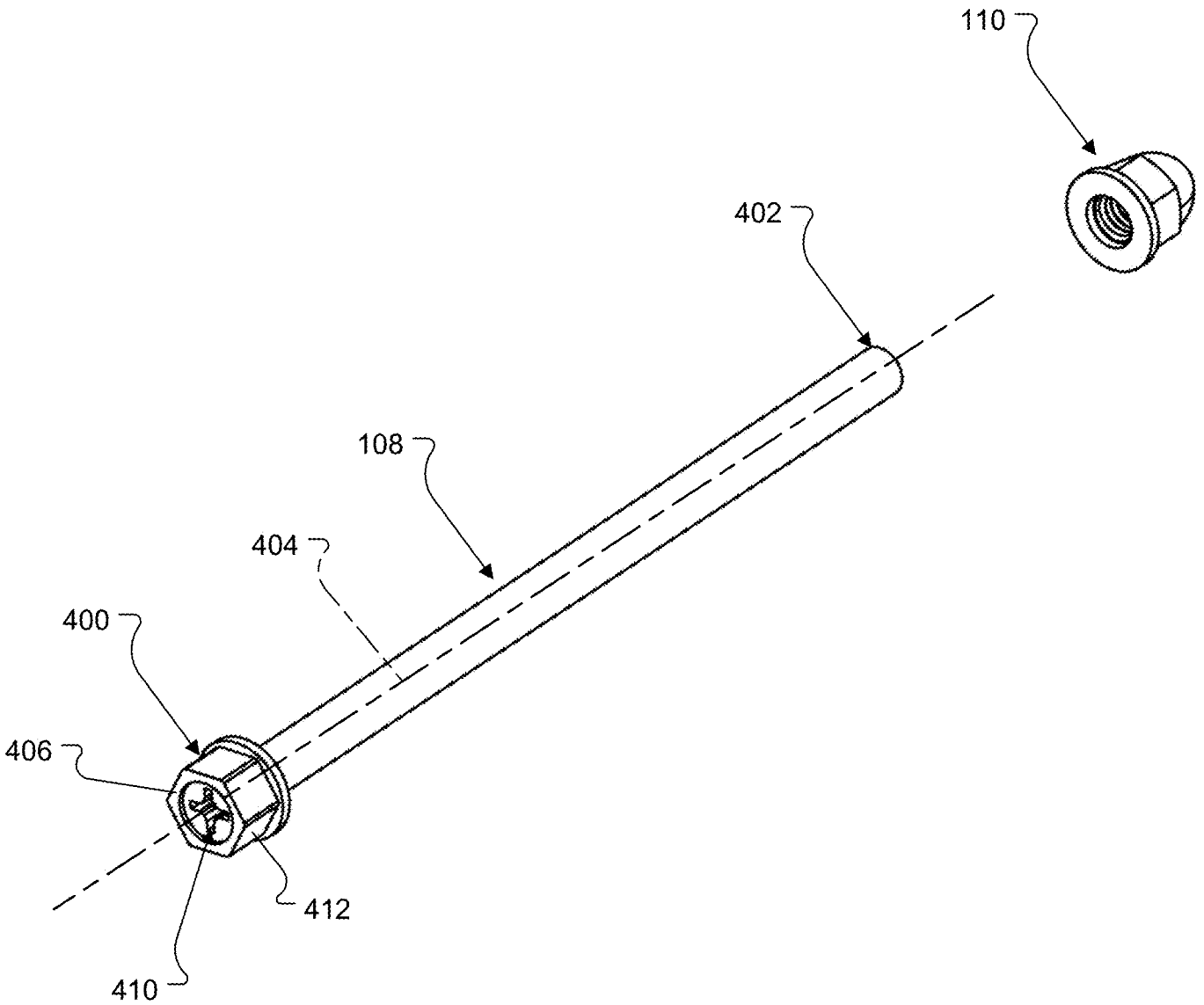
FIG. 4 is an exploded perspective view of a lead screw and acorn nut from the ceiling speaker system of FIG. 1A.

Referring also to FIG. 4, each lead screw 108 extends from a first, bottom end 400 to a second, top end 402 along a longitudinal axis 404. The lead screw includes a head 406, arranged at the first end 400, and a threaded portion 408 to engage a threaded surface of the spring-loaded tab 104. The head 406 has a flat surface with a "+" shaped recessed feature 410 configured to receive the tip of a Phillips® screwdriver. The head 406 also has a hexagonal circumferential surface that includes six individual planar surfaces 412. In some implementations, the lead screw 108 can also be turned using a driver tool having a hexagonal socket that engages the planar surfaces 412. A top end 402 of the lead screw 108 is passed through one of the screw openings 216 in the baffle 202, and, then, through a corresponding one of the screw openings 308 in the top cover 300 at which point it receives one of the acorn nuts 110.

The acorn nut 110, when attached to the second end of the lead screw 108, prevents the lead screw 108 from retracting or moving downward through the screw openings 216, 308 while allowing the lead screw 108 to rotate freely about its longitudinal axis 404 during installation and removal of the ceiling speaker system 100.

Figure 5A:
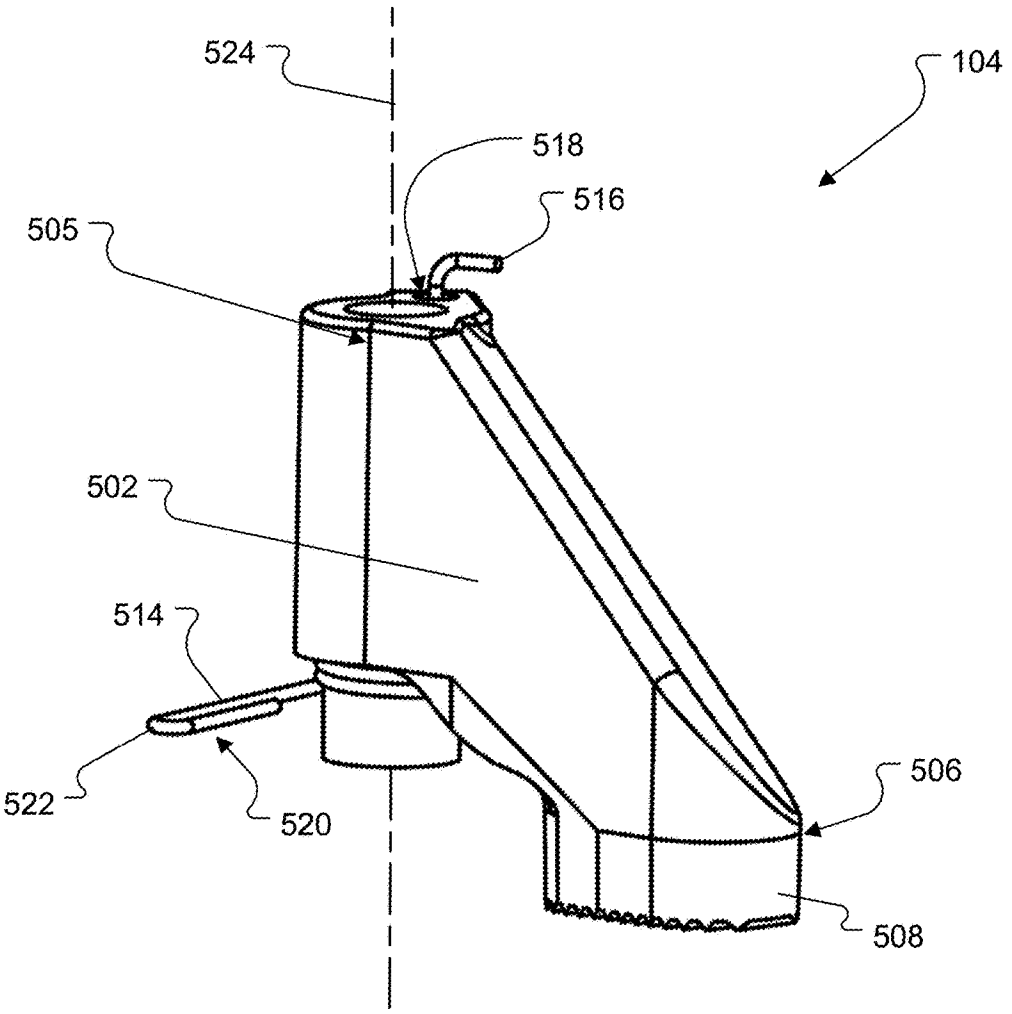
FIG. 5A is a perspective view of a spring-loaded tab from the ceiling speaker system of FIG. 1A.
Figure 5B:
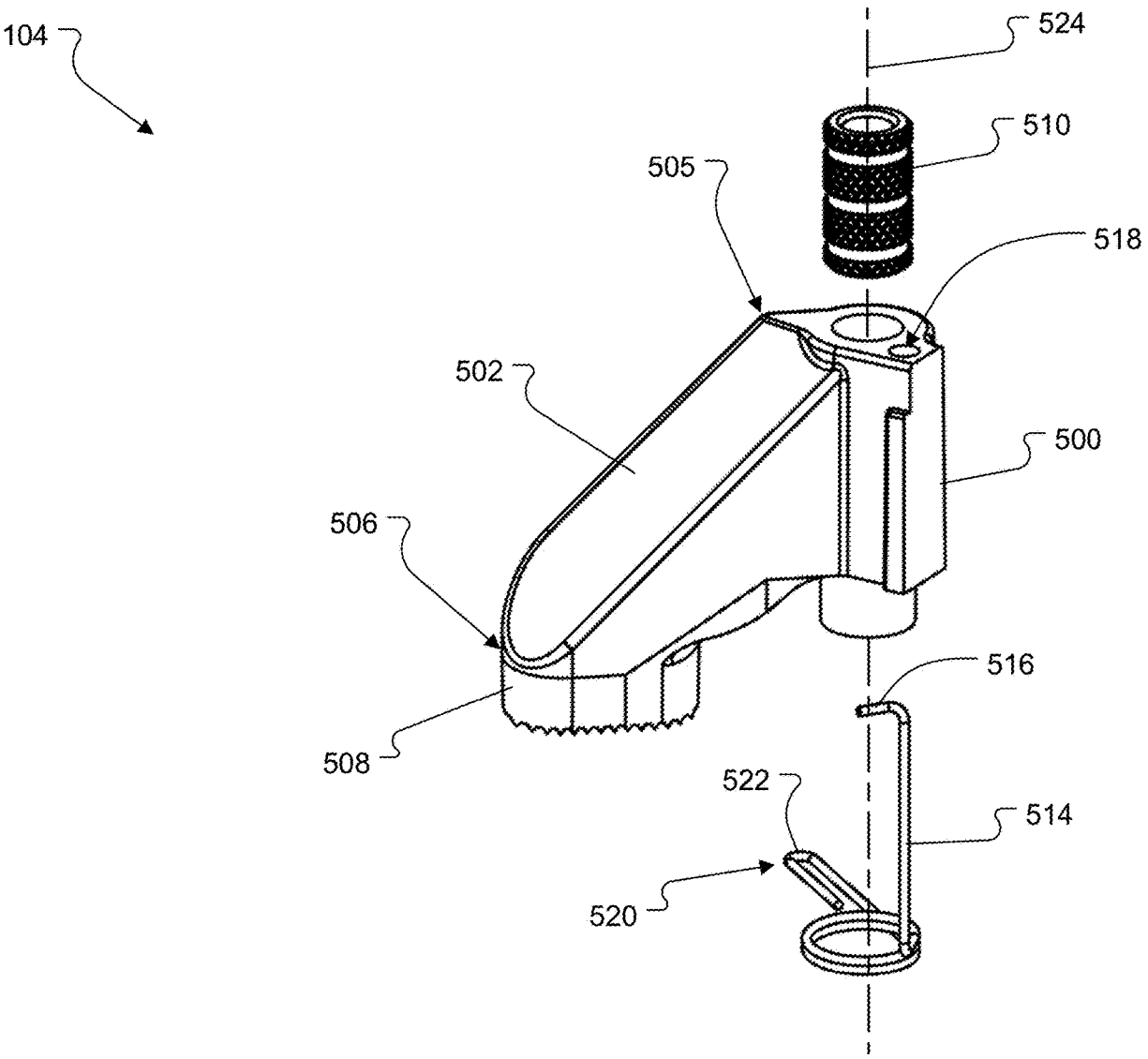
FIG. 5B is an exploded perspective view of the spring-loaded tab of FIG. 5A.

Referring to FIGS. 5A & 5B, the tab 104 includes a carriage 500 and a leg 502. A first end 505 of the leg 502 is coupled to the carriage 500 such that there is no relative movement between the carriage 500 and the leg 502. A second, free end 506 of the leg 502 supports a foot 508 which is configured to rest against a top surface of a ceiling, sandwiching the ceiling between the foot 508 and the flange 114, when the speaker system 100 is installed in a ceiling. In some cases, the foot 508 may include a textured surface or may include or be made of a material with a high coefficient of friction with the ceiling material, such as rubber, to inhibit sliding of the foot 508 when it is in contact with the top surface of the ceiling.

A threaded insert 510 is installed in a central hole 512 in the carriage 500. The threaded insert 510 provides a threaded surface that engages and rides along the lead screw 108, thereby to drive movements of the tab 104 along the lead screw 108 as the lead screw 108 is rotated. The threaded insert 510 may be formed of metal and may be insert molded or press fit into the carriage 500. Alternatively, or additionally, a threaded surface for engaging the lead screw 108 may be formed, e.g., via machining and/or molding, directly in the carriage 500.

The carriage 500, leg 502, and foot 508 may be integrally formed a plastic molding process or in a machining process. The tab 104 also includes a torsion spring 514. A first end of the torsion spring 514 includes a hook 516 that is looped through an aperture 518 in the carriage 500. A second end 520 of the torsion spring 514 engages the sidewall 206 of the enclosure 102 such that the second end 520 slides along the sidewall 206 as the tab 104 is displaced via rotation of the lead screw 108. In the illustrated example, the second end 520 of the spring 514 is bent to form a rounded edge 522 for engaging the sidewall 206.

Figure 6:
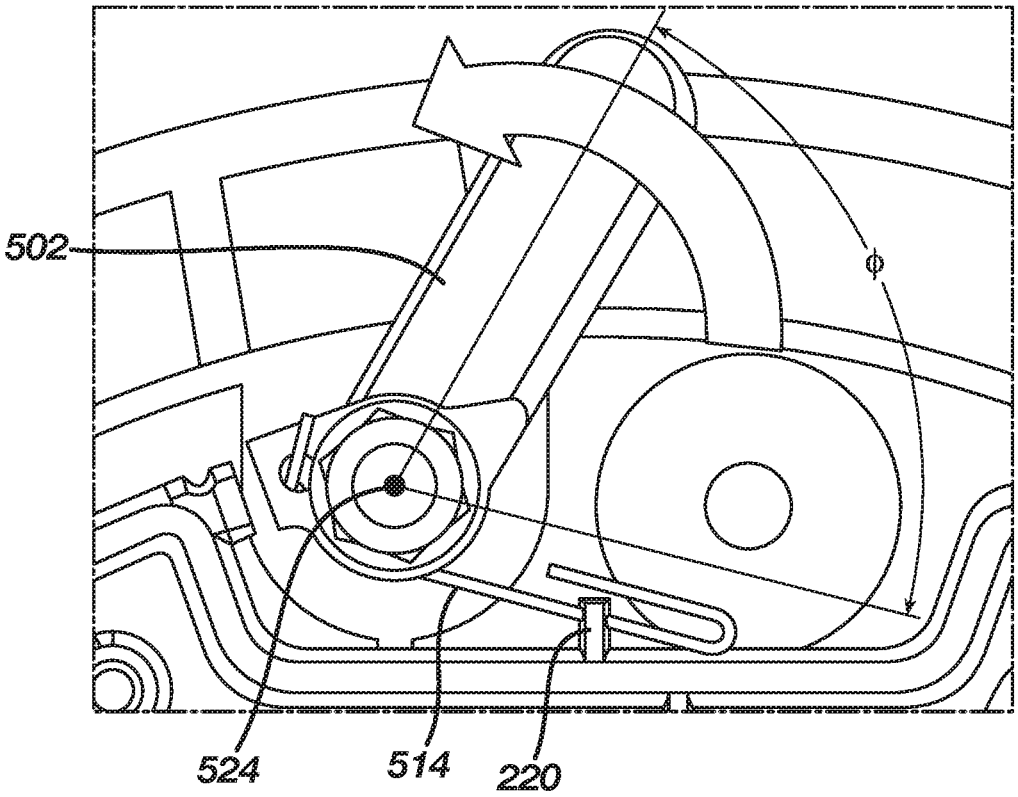
FIG. 6 is a detailed view, from the top, illustrating a range of motion of the spring-loaded tab relative to the main body of the ceiling speaker system of FIG. 1A.

As shown FIG. 6, the torsion spring 514 biases the free end 506 of the leg 502 outwardly, away from the recessed portion 214 of the sidewall 206 and such that the free end 506 of the leg 502 overlies the flange 114. The torsion spring 514 acts on the tab 104 such that the tab 104 pivots about a pivot axis 524 that is coincident with the longitudinal axis 404 of an associated one of the lead screws 108. The leg 502 is displaceable over an angle φ of between about 55 degrees and about 65 degrees, e.g., 60 degrees.

Figure 7A:
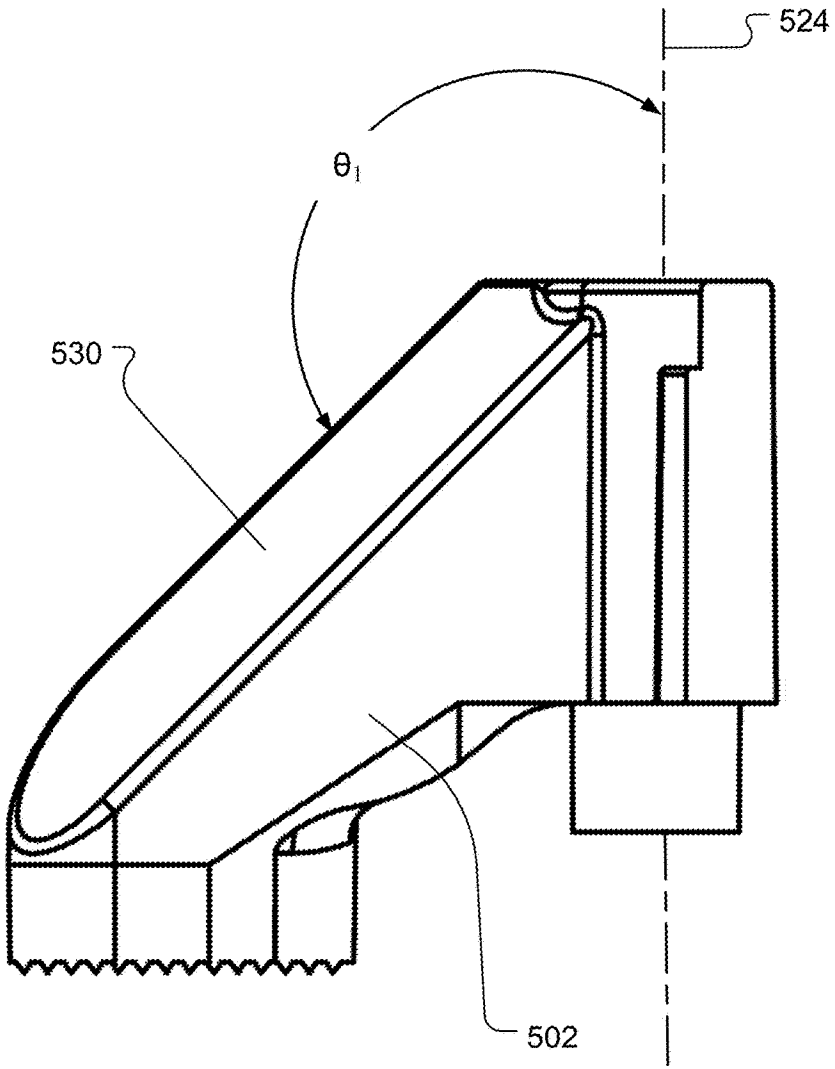
FIG. 7A is a side view of a leg from the spring-loaded tab of FIG. 5A.

Referring to FIG. 7A, the leg 502 has an angled surface 530 that assists in guiding the tab 104 into the pocket 207 (FIG. 2B) as a vertical force is applied to the leg from either the ceiling (during installation) or the retraction plate 106 (during removal). The angled surface 530 extends at a first angle $\theta_1$ (i.e., a first non-zero and non-normal angle), of between about 40 degrees and about 50 degrees, relative to the pivot axis 524 between the first and second ends 504, 506 of the leg 502.

Figure 7B:
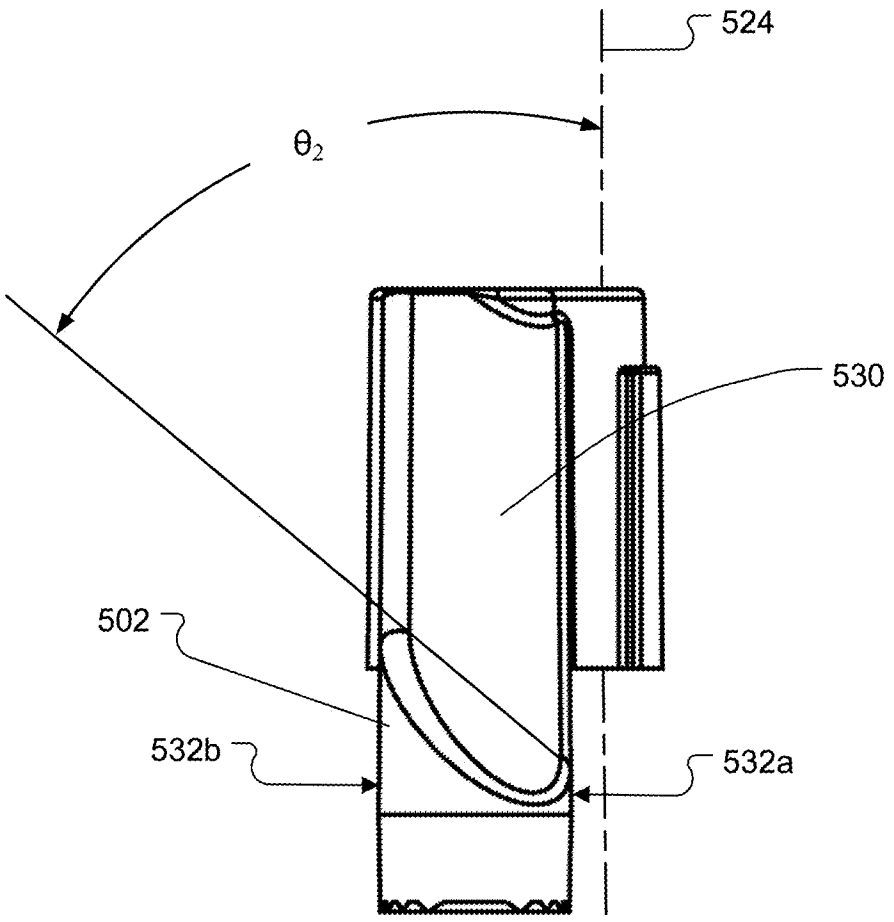
FIG. 7B is a front view of the leg of FIG. 7A.

With reference to FIG. 7B, the angled surface 530 also extends at a second angle $\theta_2$ (i.e., a second non-zero and non-normal angle), of between about 45 degrees and about 55 degrees, relative to the pivot axis 524 between opposing sides 532*a*, 532*b* of the leg 502. The opposing sides 532*a*, 532*b* lay in respective planes that are parallel with each other and with the pivot axis.

Figure 8A:
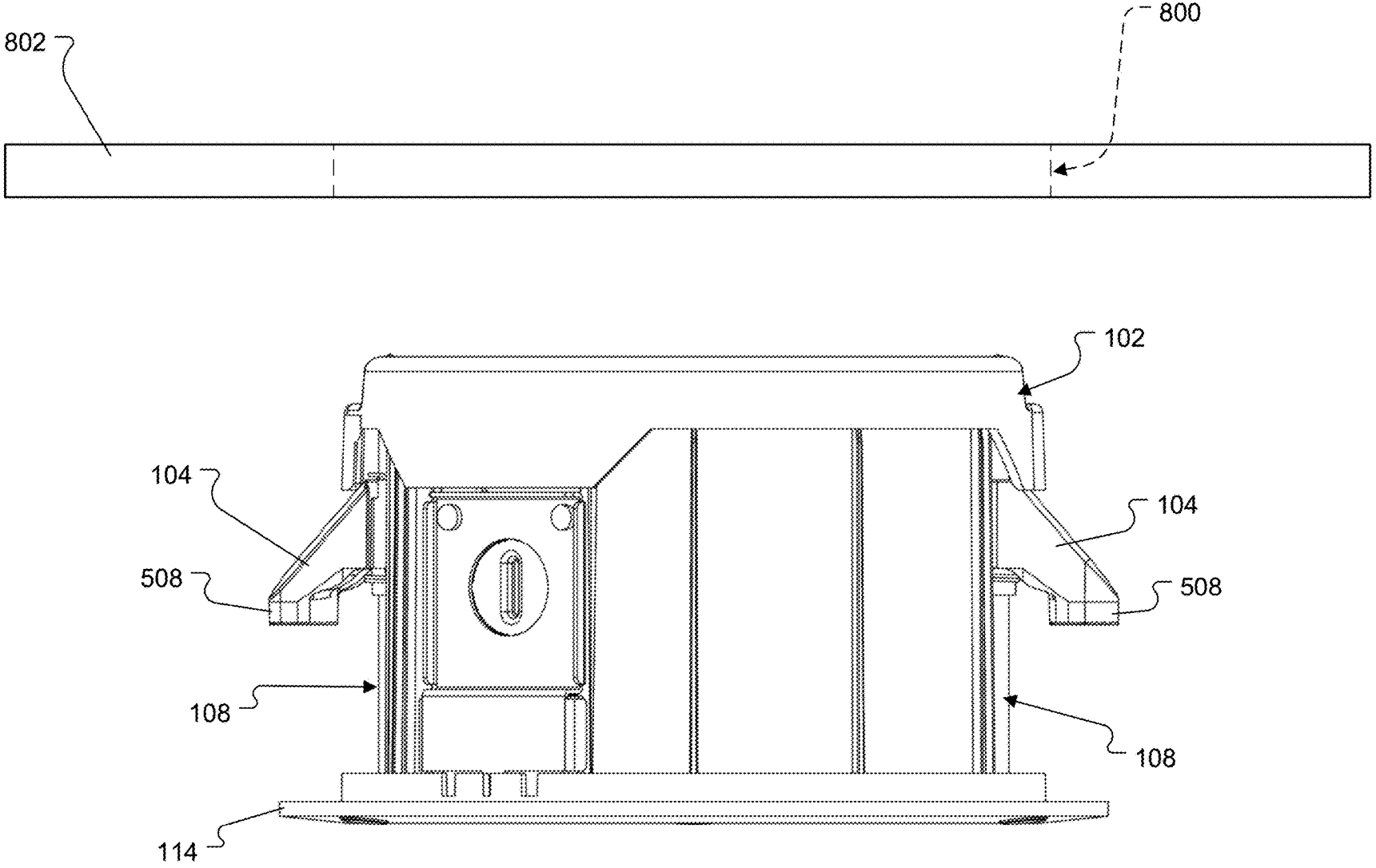
FIGS. 8A through 8D illustrate the installation of the ceiling speaker system of FIG. 1A into a ceiling.

The angled surface 530 aids in displacing the legs 502 toward the sidewall 206 of the enclosure 102 during installation. For example, FIGS. 8A-8D illustrate installation of the speaker system 100 into a hole 800 in a ceiling 802. As seen in FIG. 8A, the tabs 104 are initially positioned in a deployed position, in which the feet 508 overlie the flange 114. As illustrated in FIG. 8A, the tabs 104 are initially located as high as possible along the length of the lead screws 108 without engaging the retraction flange 106. That initial position allows for the maximum thickness of the ceiling 802; generally, all that is required is that the tabs 104 are spaced as far away as possible from the flange 114 to accommodate the maximum potential thickness of the ceiling 802. The hole 800 is sized to accept (i.e., is larger than) the top end portion of the enclosure 102 but is smaller than the flange 114.

Figure 8B:
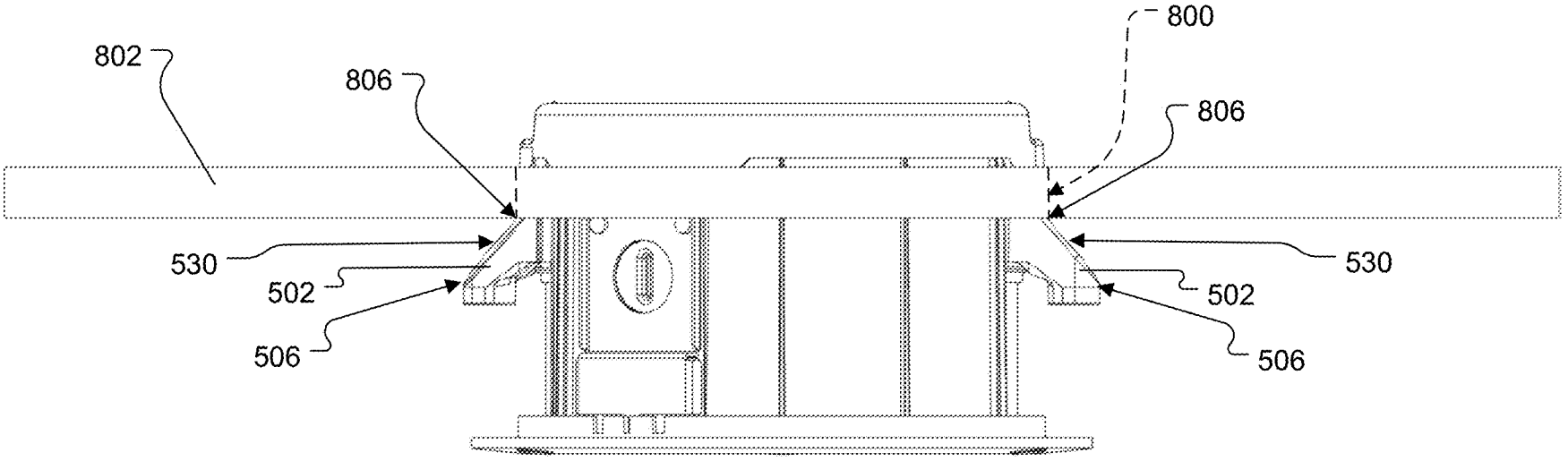

Referring to FIG. 8B, as the top end portion passes through the hole 800 the legs 502 comes into contact with an edge 806 of the hole 800. When the leg 502 engages the hole 800, the angled surface 530 causes the free end 506 of the leg 502 to rotate inwards toward the recessed portion 214 of the sidewall 206. This allows the tabs 104 to pass through the hole 800.

Figure 8C:
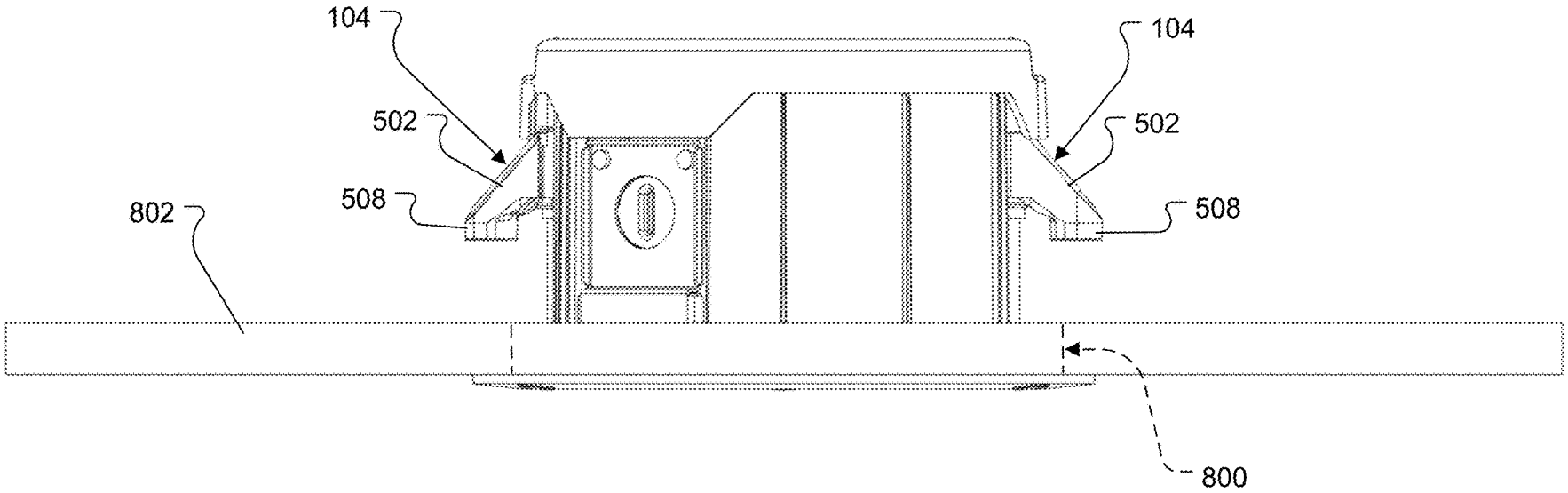

Once the feet 508 clear the hole 800, the torsion springs 514 (FIG. 5A) bias the legs 502 back toward their deployed positions, as shown in FIG. 8C. In the deployed position, the feet 508 overlie the top surface of the ceiling 802. At this point, the installer can release the ceiling speaker system 100 so that it is temporarily supported by the feet 508 on each tab 104.

Figure 8D:
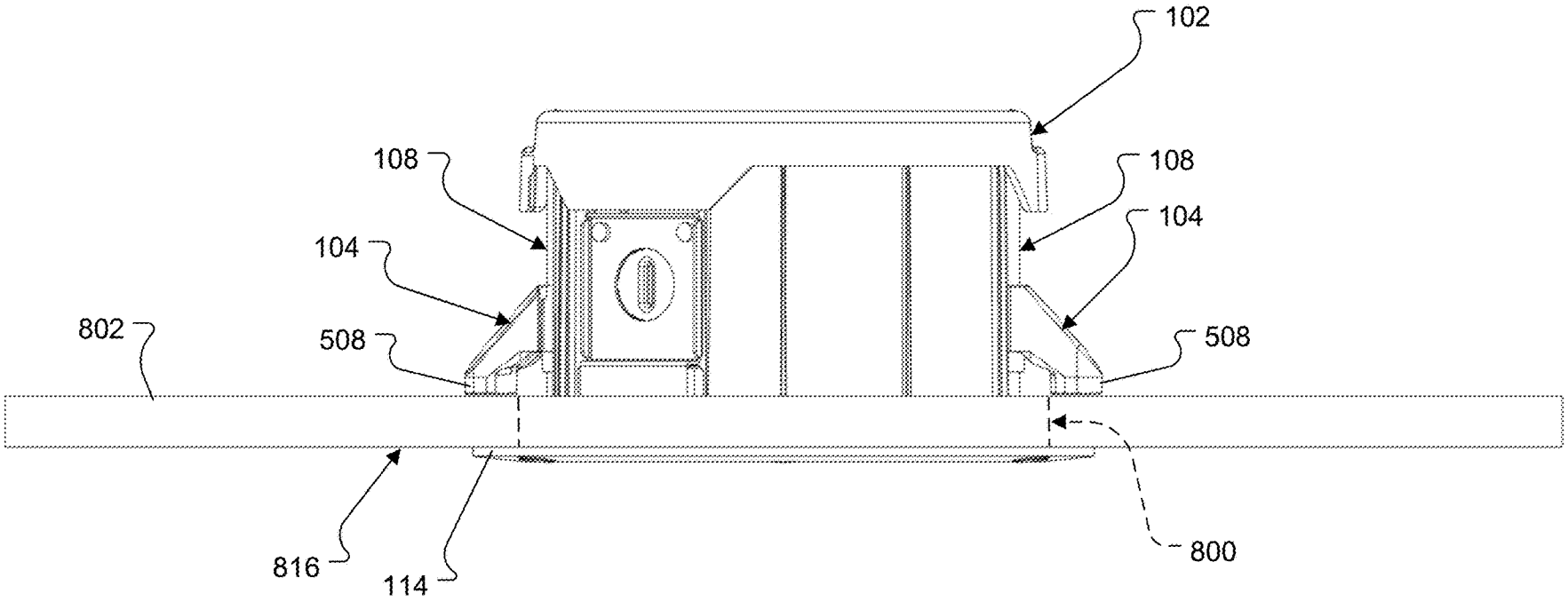

While conveniently held in place by the tabs 104, the installer rotates the lead screws 108 with a screw driver or other driver tool, to further raise the enclosure 102 until the flange 114 comes into contact with the bottom surface 816 of the ceiling 802, as shown in FIG. 8D. Further rotation of the lead screws 108 results in application of a clamping force applied between the flange 114 and the feet 508 of the tabs 104.

Figure 9:
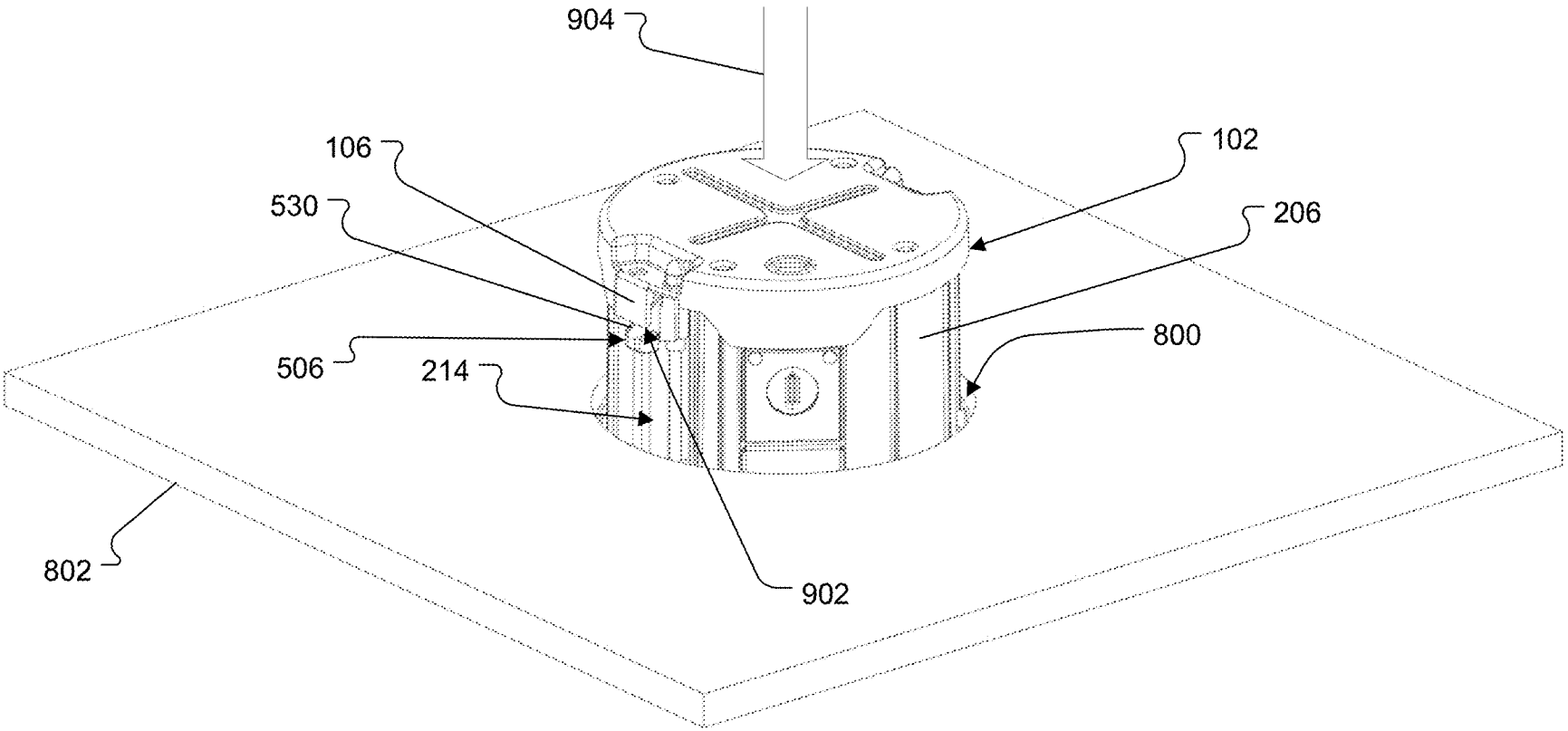
FIG. 9 illustrates the removal of the ceiling speaker system of FIG. 1A from a ceiling.

It may be desirable at a later time to remove, or "uninstall," the ceiling speaker system from the ceiling. To remove the speaker system 100 from the ceiling 802, the tabs 104 are driven up via rotation of the lead screws 108. As shown in FIG. 9, the tabs 104 are driven upward toward the top end portion of the enclosure 102 until the tabs 104 come to rest within the pockets 207 (FIGS. 1A & 1B) defined between the retraction plate 106 and the recessed portions 214 in the sidewall 206. That is, as the tabs 104 are driven upward, the angled surface 530 of each tab 104 will contact a bottom edge 902 of a corresponding one of the retractions plates 106, thereby causing the tab 104 to pivot about the pivot axis 524 (FIG. 5A). The continued upward movement of the tabs 104 will cause the free ends 506 of the legs 502 to be pushed inward toward the recessed portions 214 in the sidewalls 206 via the interaction between the angled surfaces 530 of the tabs 104 and the bottom edges 902 of the retraction plates 106. Once the tabs 104 are located in the respective pockets 207 (FIGS. 1A & 1B), the retraction plates 106 will hold the free ends 506 of the tabs 104 in the retracted position, thereby allowing removal of the speaker system 100 from the ceiling 802 without interference from the tabs 104, as illustrated by arrow 904 in FIG. 9.

While the examples described above include two mounting devices per ceiling speaker system, it will be recognized that in other ceiling mount configurations fewer or more mounting devices may be used with a speaker system. Moreover, it will be recognized that the mounting devices can be used to mount other types of objects to a ceiling and to allow for their convenient removal from the ceiling.

Figure 10:
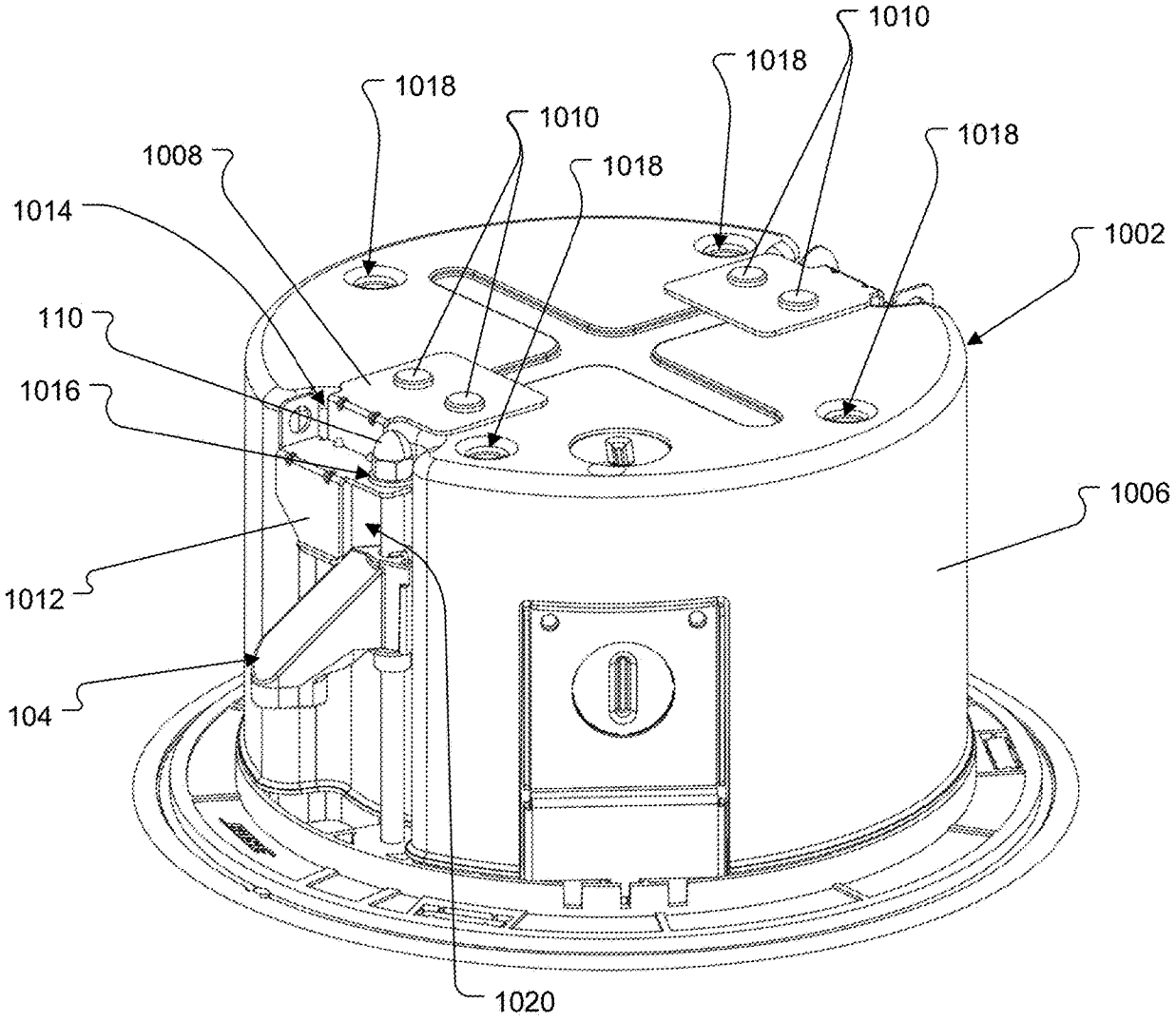
FIG. 10 is a perspective view of another embodiment of a ceiling speaker system as shown from the top and side.

FIG. 10 illustrates another implementation of a ceiling speaker system 1000 that utilizes an alternative design for a top cover 1002. The top cover 1002 includes a substantially flat base 1004 and a substantially cylindrical edge 1006 that extends outward from the base 1004. In the implementation illustrated in FIG. 10, the substantially cylindrical edge 1006 extends along substantially an entire length of the sidewall 206 of the main body 200 (FIG. 2A).

The implementation illustrated in FIG. 10 includes a pair of brackets 1008, which are secured to the top cover 1002, e.g., via rivets 1010. The brackets 1008 each define a corresponding retraction plate 1012, which function in substantially the same manner as described above with respect to the implementation illustrated in FIGS. 8A-8D. The brackets 1008 also defines a pair of recesses 1014 within which respective distal ends of the lead screws 108 are rotatably received and the acorn nuts 110 are disposed. The distal ends of the lead screws 108 are supported in screw openings 1016 in respective ones of the brackets 1008. In some cases, bushings or bearings may be disposed within or about the screw openings to help enable rotation of the lead screws 108.

The top cover 1002 defines a plurality of screw holes 1018 which align with mounting holes 218 (FIG. 2B) in the main body 200 for receiving fasteners to secure the top cover 1002 to the main body 200 to define an acoustic cavity therebetween. When assembled, the recesses 1014 in the brackets 1008 coincide with the recessed portions 214 in the sidewall 206. The retraction plates 1012 and the recessed portions 214 in the sidewall 206 together define pockets 1020 for receiving the tabs 104 in substantially the same manner as discussed above with respect to the implementation illustrated in FIGS. 8A-8D. The top cover 1002 and brackets 1008 may be formed as individual metal pieces.

In some implementations, the carriage, the leg, the foot, the threaded insert, and torsion spring are all integrally formed by plastic molding process or machining process.

A number of implementations have been described. Nevertheless, it will be understood that additional modifications may be made without departing from the scope of the inventive concepts described herein, and, accordingly, other implementations are within the scope of the following claims.

What is claimed is:

1. A device for securing an object to a ceiling, comprising:
- a lead screw having a longitudinal axis about which the lead screw rotates;
- a spring-loaded tab comprising:
  - a carriage that is coupled to the lead screw such that the carriage is displaceable along a length of the lead screw via rotation of the lead screw;
  - a leg including a first end that is coupled to the carriage such that there is no relative movement between the leg and the carriage, and a second, free end; and
  - a spring biasing the free end of the leg outwardly, away from the object into a deployed position, the leg being rotatable about a pivot axis coincident with the longitudinal axis of the lead screw; and
- a retraction plate secured to the object so as to form a pocket therebetween,
- wherein, when the device is attached to the object and the object moves in a first direction through a hole in the ceiling such that the leg contacts an edge of the hole, the leg is urged from the deployed position toward a retracted position, and wherein when the object is further moved in the first direction such the leg is clear of the hole, the leg returns to the deployed position via a force applied by the spring,
- wherein the leg comprises an angled surface configured to engage edge of the hole to urge the leg toward a retracted position as the object moves in the first direction through the hole, and
- wherein, when the lead screw is rotated to drive the spring-loaded tab toward a top end portion of the object, the retraction plate engages the angled surface to urge the leg into the retracted position within the pocket.

2. The device of claim 1, wherein the angled surface is arranged at a first non-zero and non-normal angle, relative to the pivot and longitudinal axes, between the first and second ends of the leg.

3. A device for securing an object to a ceiling, comprising:
- a lead screw having a longitudinal axis about which the lead screw rotates; and
- a spring-loaded tab comprising:
  - a carriage that is coupled to the lead screw such that the carriage is displaceable along a length of the lead screw via rotation of the lead screw;
  - a leg including a first end that is coupled to the carriage such that there is no relative movement between the leg and the carriage, and a second, free end; and
  - a spring biasing the free end of the leg outwardly, away from the object into a deployed position, the leg being rotatable about a pivot axis coincident with the longitudinal axis of the lead screw,
- wherein, when the device is attached to the object and the object moves in a first direction through a hole in the ceiling such that the leg contacts an edge of the hole, the leg is urged from the deployed position toward a retracted position, and wherein when the object is further moved in the first direction such the leg is clear of the hole, the leg returns to the deployed position via a force applied by the spring,
- wherein the leg comprises an angled surface configured to engage edge of the hole to urge the leg toward a retracted position as the object moves in the first direction through the hole,
- wherein the angled surface is arranged at a first non-zero and non-normal angle, relative to the pivot and longitudinal axes, between the first and second ends of the leg, and
- wherein the angled surface also extends at a second non-zero and non-normal angle, relative to the pivot axis, between opposing sides of the leg.

4. The device of claim 1, wherein the carriage and the leg are coupled such that relative movement therebetween is inhibited.

5. The device of claim 4, wherein the carriage and the leg are integrally formed.

6. The device of claim 1, wherein the carriage includes threaded surface that engages threads on the lead screw.

7. The device of claim 6, wherein the carriage includes a threaded insert which defines the threaded surface.

8. A device for securing an object to a ceiling, comprising:

a lead screw having a longitudinal axis about which the lead screw rotates; and a spring-loaded tab comprising:

a carriage that is coupled to the lead screw such that the carriage is displaceable along a length of the lead screw via rotation of the lead screw;

a leg including a first end that is coupled to the carriage such that there is no relative movement between the leg and the carriage, and a second, free end; and a spring biasing the free end of the leg outwardly, away from the object into a deployed position, the leg being rotatable about a pivot axis coincident with the longitudinal axis of the lead screw, wherein, when the device is attached to the object and the object moves in a first direction through a hole in the ceiling such that the leg contacts an edge of the hole, the leg is urged from the deployed position toward a retracted position, and wherein when the object is further moved in the first direction such the leg is clear of the hole, the leg returns to the deployed position via a force applied by the spring, wherein the leg comprises an angled surface configured to engage edge of the hole to urge the leg toward a retracted position as the object moves in the first direction through the hole, wherein the carriage includes threaded surface that engages threads on the lead screw, and wherein the spring comprises a first end that is coupled to the spring-loaded tab, and a second end that engages the object such that the second end slides along a surface of the object as the spring-loaded tab is displaced via rotation of the lead screw.

9. The device of claim 8, wherein the first end of the spring includes a hook that is looped through an aperture in the spring-loaded tab.

10. A device for securing an object to a ceiling, comprising:

a lead screw having a longitudinal axis about which the lead screw rotates;

a spring-loaded tab comprising:

a carriage that is coupled to the lead screw such that the carriage is displaceable along a length of the lead screw via rotation of the lead screw;

a leg including a first end that is coupled to the carriage such that there is no relative movement between the leg and the carriage, and a second, free end; and a spring biasing the free end of the leg outwardly, away from the object into a deployed position, the leg being rotatable about a pivot axis coincident with the longitudinal axis of the lead screw; and a retraction plate secured to the object so as to form a pocket therebetween, wherein, when the device is attached to the object and the object moves in a first direction through a hole in the ceiling such that the leg contacts an edge of the hole, the leg is urged from the deployed position toward a retracted position, and wherein when the object is further moved in the first direction such the leg is clear of the hole, the leg returns to the deployed position via a force applied by the spring, wherein the leg comprises an angled surface configured to engage edge of the hole to urge the leg toward a retracted position as the object moves in the first direction through the hole, and wherein, when the lead screw is rotated to drive the spring-loaded tab toward a top end portion of the object, the retraction plate engages the leg to urge the leg into the retracted position within the pocket.

11. A ceiling speaker system for mounting in a hole in a ceiling, comprising:

an enclosure;

an electro-acoustic transducer supported by the enclosure;

a plurality of lead screws supported by the enclosure, each of the plurality of lead screws having a longitudinal axis about which the lead screw rotates;

a plurality of spring-loaded tabs, each of the plurality of spring-loaded tabs comprising:

a carriage that is coupled to the lead screw such that the carriage is displaceable along a length of an associated one of the plurality of lead screws via rotation of the associated one of the plurality of lead screws; and a leg including a first end that is coupled to the carriage such that there is no relative movement between the leg and the carriage, and a second, free end; and a spring biasing the free end of the leg outwardly, away from the enclosure into a deployed position, the leg being rotatable about a pivot axis coincident with the longitudinal axis of the associated one of the plurality of lead screws; and a plurality of retraction plates coupled to the enclosure so as to form respective pockets therebetween, wherein, when a top end portion of the enclosure is moved in a first direction through a hole in a ceiling such that the legs contact an edge of the hole, the legs are urged from the deployed position toward a retracted position, and wherein when the top end portion of the enclosure is further moved in the first direction such the legs are clear of the hole, the legs return to the deployed position via a force applied by the spring, wherein each of the legs comprises an angled surface configured to engage edge of the hole to urge the leg toward a retracted position as the ceiling speaker system moves in the first direction through the hole, wherein, when the lead screws are rotated to drive the spring-loaded tabs toward a top end portion of the enclosure, the retraction plates engage the angled surfaces to urge the legs into the retracted position within the pockets.

12. The ceiling speaker system of claim 11, further comprising a plurality of retraction plates coupled to the enclosure so as to form respective pockets therebetween.

13. The ceiling speaker system of claim 11, further comprising a flange coupled to the enclosure, and wherein, when the top end portion of the enclosure is moved through the hole in the ceiling such that the legs are clear of the hole, the lead screws are rotatable to displace the spring-loaded tabs such that the ceiling is clamped between the spring loaded tabs and the flange.

14. The ceiling speaker system of claim 11, wherein the angled surface is arranged at a first non-zero and non-normal angle, relative to the pivot and longitudinal axes, between the first and second ends of the leg.

15. A ceiling speaker system for mounting in a hole in a ceiling, comprising:

an enclosure;

an electro-acoustic transducer supported by the enclosure;

a plurality of lead screws supported by the enclosure, each of the plurality of lead screws having a longitudinal axis about which the lead screw rotates; and a plurality of spring-loaded tabs, each of the plurality of spring-loaded tabs comprising:

a carriage that is coupled to the lead screw such that the carriage is displaceable along a length of an associated one of the plurality of lead screws via rotation of the associated one of the plurality of lead screws; and a leg including a first end that is coupled to the carriage such that there is no relative movement between the leg and the carriage, and a second, free end; and a spring biasing the free end of the leg outwardly, away from the enclosure into a deployed position, the leg being rotatable about a pivot axis coincident with the longitudinal axis of the associated one of the plurality of lead screws, wherein, when a top end portion of the enclosure is moved in a first direction through a hole in a ceiling such that the legs contact an edge of the hole, the legs are urged from the deployed position toward a retracted position, and wherein when the top end portion of the enclosure is further moved in the first direction such the legs are clear of the hole, the legs return to the deployed position via a force applied by the spring, wherein the angled surface is arranged at a first non-zero and non-normal angle, relative to the pivot and longitudinal axes, between the first and second ends of the leg, and wherein the angled surface also extends at a second non-zero and non-normal angle, relative to the pivot axis, between opposing sides of the leg.

16. The ceiling speaker system of claim 11, wherein the carriage and the leg of each of the spring-loaded tabs are coupled such that relative movement therebetween is inhibited.

* * * * *